US006347422B2

(12) United States Patent
Heavrin

(10) Patent No.: US 6,347,422 B2
(45) Date of Patent: Feb. 19, 2002

(54) BED PADS

(76) Inventor: Thomas Heavrin, 501 Mountain Ash, Arlington, OH (US) 45814

( * ) Notice: Subject to any disclaimer, the term of this patent is extended or adjusted under 35 U.S.C. 154(b) by 0 days.

(21) Appl. No.: 09/809,881

(22) Filed: Mar. 16, 2001

Related U.S. Application Data

(60) Provisional application No. 60/198,591, filed on Apr. 19, 2000.

(51) Int. Cl.[7] ..... A47C 21/08

(52) U.S. Cl. ..... 5/663; 5/425; 5/427

(58) Field of Search ..... 5/630, 632, 424, 5/425, 427, 663, 946

(56) References Cited

U.S. PATENT DOCUMENTS 5,035,014 A * 7/1991 Blanchard ..... 5/424
5,044,025 A * 9/1991 Hunsnger et al. ..... 5/663
5,187,824 A 2/1993 Stryker
5,481,772 A * 1/1996 Glynn et al. ..... 5/663
5,689,839 A 11/1997 Laganiére et al.
5,864,900 A 2/1999 Landau
5,867,853 A 2/1999 Feld
5,890,244 A 4/1999 Cartwright et al.
5,987,666 A * 11/1999 Zigmont ..... 5/663

* cited by examiner

*Primary Examiner*—Michael F. Trettel
(74) *Attorney, Agent, or Firm*—Emch, Schaffer, Schaub & Porcello Co., L.P.A.

(57) ABSTRACT

This article is a padded gap protector for hospital beds that provides zero clearance no matter what the articulated position of the bed is. The pad remains in compression with the mattress and closes the gap between the mattress and side rails. The pad provides a zero gap when the matters is in a horizontal position and when the mattress is secured in an articulate position such as an elevated position. Straps secure the pad to a bed frame beneath the mattress to maintain compression and a V-shaped section with no material or a soft material maintains the zero gap when the mattress is in an articulate position. Another set of straps secure the top of the pad to the top rail of the bed rails.

21 Claims, 5 Drawing Sheets

BED PADS

This application claims benefit of Provisional application No. 60/198,591 filed Apr. 19, 2000.

TECHNICAL FIELD

This invention relates to bed pads for filling any gaps in hospital or nursing home beds. My bed pads may be referred to as gapless bed pads or zero gap bed pads. The most typical gap exists between side rails and the mattress of a long term care bed.

BACKGROUND OF THE INVENTION

Hospital beds traditionally had some type of collapsible side rail on each side of the mattress, so that a patient on the bed cannot inadvertently roll off of the bed and receive serious injuries from a fall to the floor. Padded covers, bumper wedges and the like also are used with the bed-rails to improve the comfort and safety of patients in long-term care facilities. Despite these improved configurations, a rather large gap still exists between the rails, pads, headboard, footboard and the bed mattress. The gap is even more pronounced when the bed is in an articulated or elevated position. The long term care industry refers to this as "the 1 inch gap issue". Any gap of more than one inch associated with raised bed rails is unacceptable. Consequently, a need remains for improvement in the safety of these devices.

BRIEF SUMMARY OF THE INVENTION

I have invented a padded gap protector that provides zero clearance no matter what the articulated position of the bed is. The pad remains in compression with the mattress and closes the gap between the mattress and side rails. The pad provides a zero gap when the mattress is in a horizontal position and when the mattress is secured in an articulate position such as an elevated position. Straps secure the pad to the bed frame below the mattress to maintain compression and an V-shaped section of soft material maintains the zero gap when the mattress is in an articulated position. Another set of straps secure the top of the pad to the bed rail. With foot pads, this invention provides 360° zero gap protection.

The pad's zero gap clearance reduces the risk of "poke-through", that is, a limb or digit being caught between the mattress and the pad, rail to rail, rail to headboard or rail to footboard. The pad is soft, well padded, nonabrasive, cleanable, and moisture resistant. The pad does not impede rapid lowering of bed-rails. The pad is quickly and easily attachable and detachable and does not impede charging sheets or providing medical attention.

The pad is for use with a bed having a mattress and bed rails. The pad includes a cover defining an interior space formed of a material the material being flexible, non-abrasive and substantially resistant to penetration by an appendage of a person. A top attachment means secures a top section of the cover to the top rail of the bed rails and a bottom attachment means secures a bottom section of the cover to a bed frame beneath the mattress. A foam material fills the interior space defined by the cover wherein the foam material has a high density. The higher density foam material further defines at least one V-shaped cavity pointing downwardly towards the bottom section of the cover. A lower density foam fills the V-shaped cavity. The bottom surface of the cover is positioned adjacent a top surface of the mattress to provide zero clearance between the mattress and side rails.

DETAILED DESCRIPTION OF THE INVENTION

The pads of this invention are intended for placement on the inside of the rails of a long term care bed. The pads can be flipped to the outside of the rails to enable a quick linear change. This is done by leaving the top ¾ inch straps and quick release buckles in place and releasing (unfastening) the bottom 1 inch, quick release buckles.

The top straps and buckles are not intended to be so tight that the straps will not swivel or travel along the top rail rod.

Figure 1:
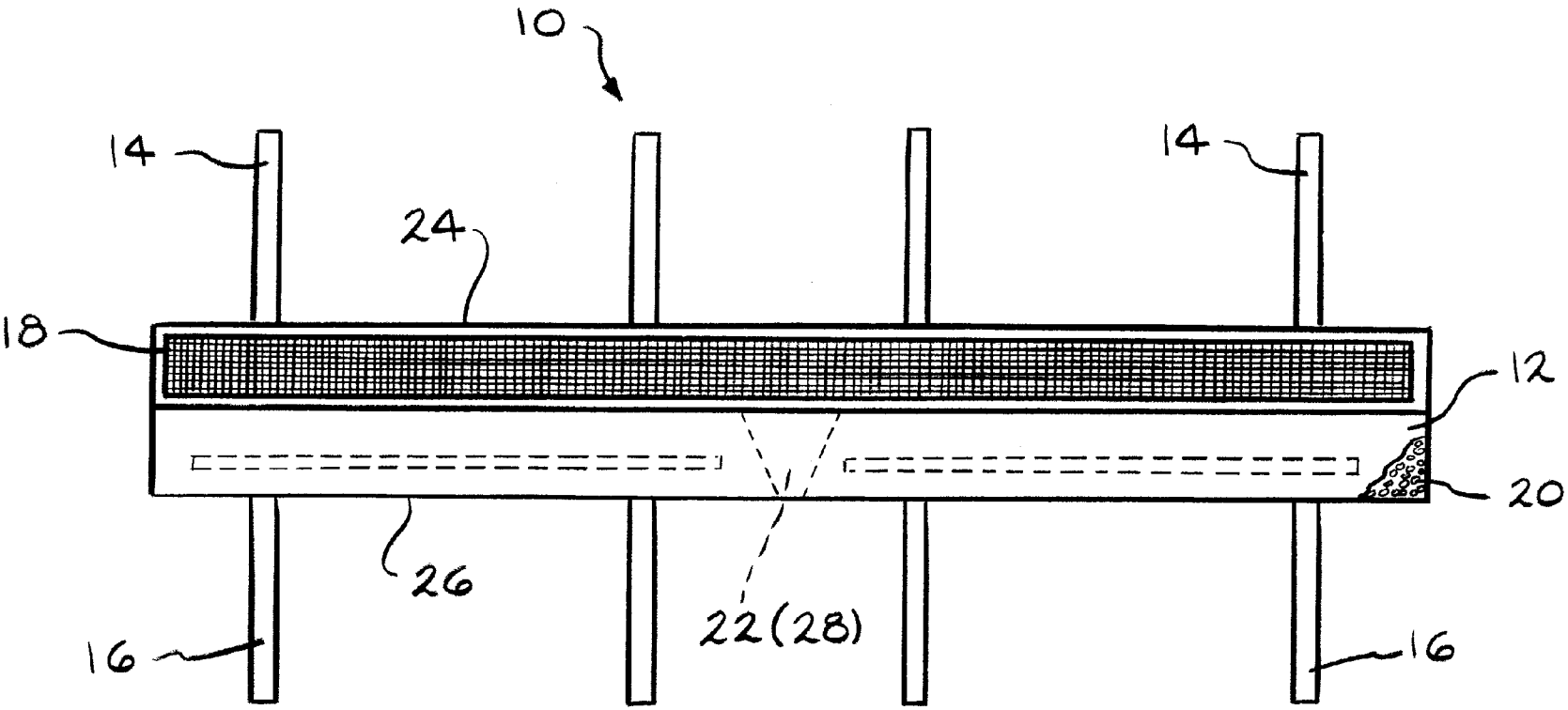
FIG. 1 shows side view of the pad of this invention with a mesh or see through top.

FIG. 1 shows a side view of bed pad 10 of this invention for use with a long term care bed. Pad 10 includes cover 12, top straps 14, bottom straps 16 and mesh (see through) top 18. Cover 12 encases foam 20 and foam 20 includes at least one V-shaped cavity 22 shown in phantom pointing downwardly. Pad 10 also has top edge 24 and bottom edge 26. V-shaped cavity 22 may be avoid or may include low density foam 28.

Figure 2:
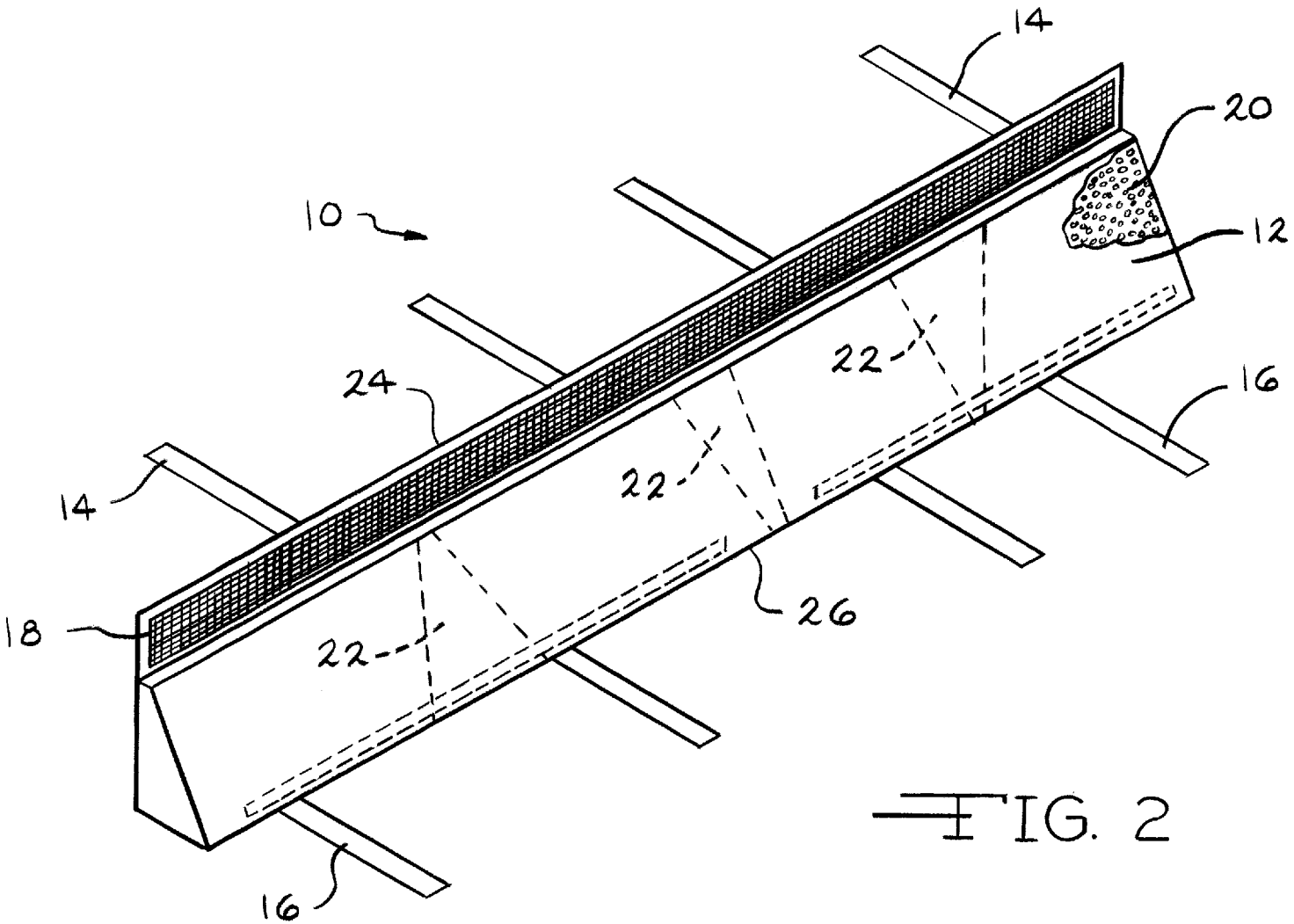
FIG. 2 shows a perspective view of the pad of this invention with a mesh top.

FIG. 2 shows a perspective view of pad 10 with more than one V-shaped cavity 22. Pad 10 may use a multiplicity of cavities 22. Cavities 22 may be filled or unfilled. Also, cavities 22 may point upwardly to top edge 24, downwardly towards bottom edge 26 or any combination thereof. Preferably, at least one cavity 22 points downwardly.

Figure 3:
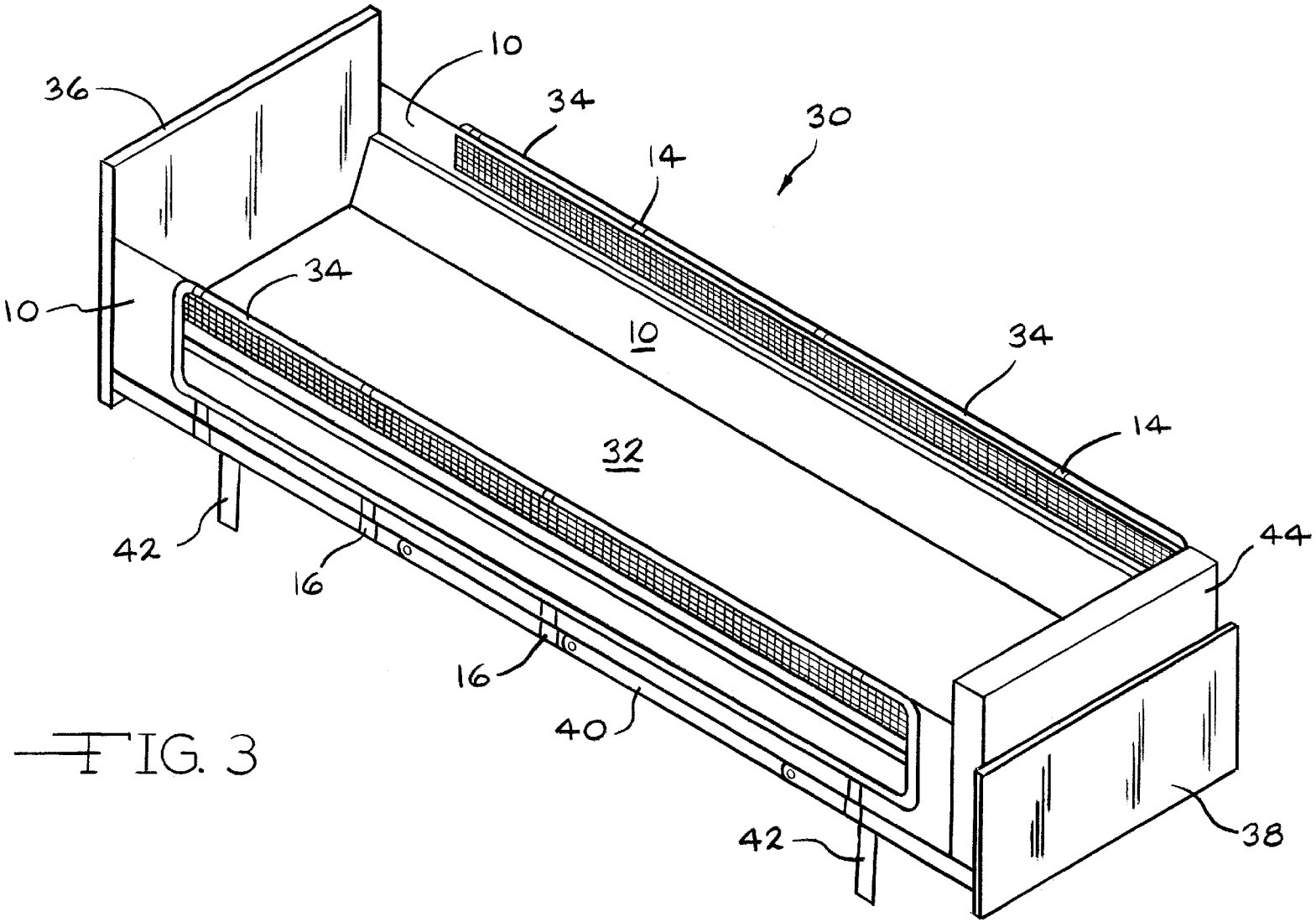
FIG. 3 shows the pad of this invention installed on a hospital bed with a mattress and side rails in a horizontal position.

FIG. 3 shows pad 10 installed on a long term care bed in a horizontal position. FIG. 3 shows pad 10 on bed 30. Bed 30 includes mattress 32, side rails 34, head board 36, foot board 38, frame 40 and legs 42. FIG. 3 shows full length side rails 34. Frequently, however, rails 34 and pads 10 are ½ rails and ½ pads located near the top or head of bed 10 adjacent head board 36. Head or foot pad 44 also may be used with gapless bed rail pads 10. FIG. 3 shows foot pad 44 in place adjacent foot board 38 and between pads 10. Foot pad 44 is in compression with pads 10 and mattress 32. Pads 10 also are in compression with head board 36.

Figure 4:
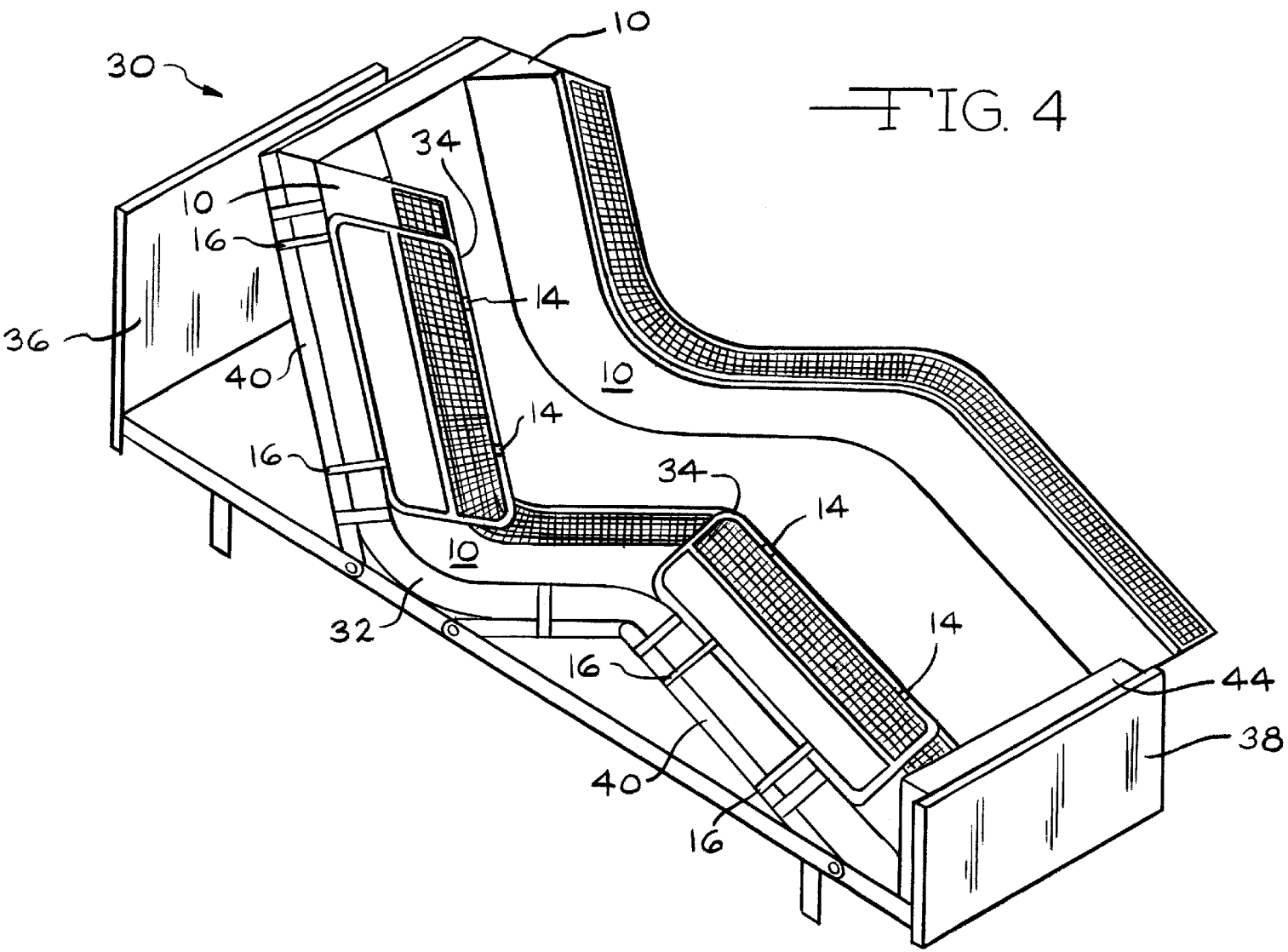
FIG. 4 shows the pad of this invention installed on a hospital bed in an articulate position.

FIG. 4 shows pads 10 installed on long term care bed 30. Bed 30 is in an articulate position. FIG. 4 also shows top straps 14 secured to the top of side rails 34 and bottom straps 16 secured to frame 40. Note, pads 10 stay in compression with mattress 32 even when bed 30 is in an articulate position.

Figure 5:
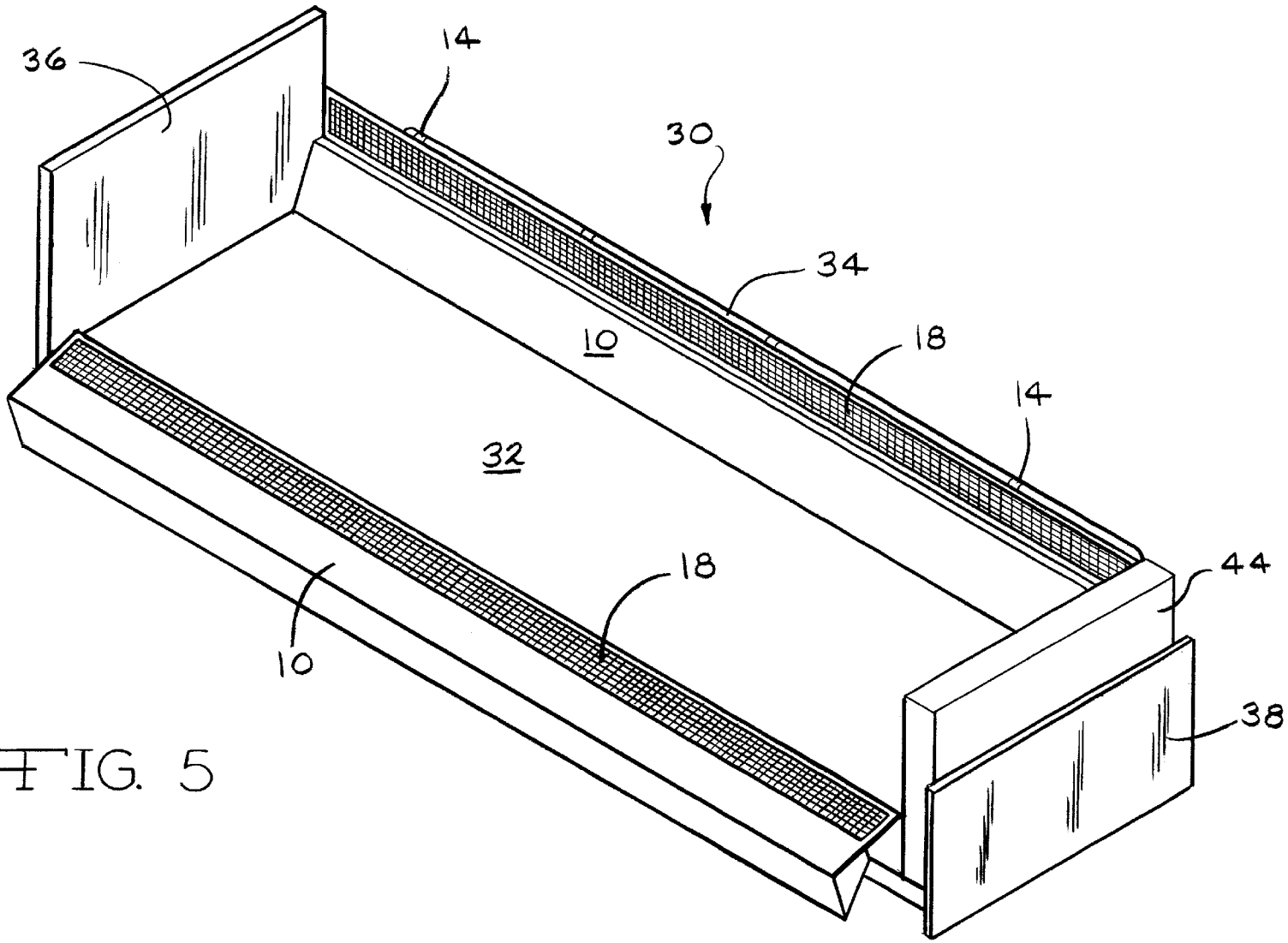
FIG. 5 shows a hospital bed with one rail up and one rail down.

FIG. 5 shows long term care bed 30 with one side rail 34 up and one side rail 34 down. With side rail 34 in a down position, pad 10 flips over to the outside of rail 34 for linen changes. Down rail 34 and flipped pad 10 are below mattress 32.

The pad of this invention uses a foam which may vary widely. Preferably, the foam is a polyurethane foam. The polyurethane likewise varies widely. Generally, it is a thermoplastic polymer produced by the condensation reaction of a polyisocyanate and a hydroxyl-containing material, e.g., a polyol derived from propylene oxide or trichlorobutylene oxide. The basic polymer unit is formed as follows: $R_1NCO+R_2OH \rightarrow R_1NHCOOR_2$.

The organic polyisocyanates which may be employed for the "A side" component include aromatic, aliphatic, and cycloaliphatic polyisocyanates and combinations thereof. Representative of these types are the diisocyanates such as m-phenylene diisocyanate, 2,4-toluene diisocyanate, 2,6-toluene diisocyanate, mixtures of 2,4-and 2,6-toluene diisocyanate, hexamethylene diisocyanate, tetramethylene diisocyanate, cyclohexane-1,4-diisocyanate, hexahydrotoluene diisocyanate (and isomers), naphthalene-1,5-diisocyanate, 1-methoxyphenyl-2,4-diisocyanate, 2,2'-, 2,4'-, and 4,4'-diphenylmethane diisocyanate, 4,4'-biphenylene diisocyanate, 3,3'-dimethoxy-4,4'-biphenyl diisocyanate, and 3,3'-dimethydiphenylmethane-4,4'-diisocyanate; the triisocyanates such as 4,4',4"-triphenylmethane triisocyanate, and toluene 2,4,6-triisocyanate; and the tetraisocyanates such as 4,4'-dimethyldiphenylmethane 2,2'-5,5'-tetraisocyanate; and polymericpolyisocyanates such as polymethylene polyphenylene polyisocyanate. Especially useful die to their availability and properties are 4,4'-diphenylmethane diisocyanate and polymethylene polyphenylene polyisocyanate.

Also used are the easily accessible, optionally uretonimine-carbodiimide and urethane group-containing aromatic di- and polyisocyanates such as 2,2'-, 2,4'-, 4,4'-diphenylmethane diisocyanate (MDI), as well as any desired mixtures of these isomers, and mixtures of 2,2'-, 2,4%, 4,4'-diphenylmethane diisocyanate and polyphenyl polymethylene polyisocyanates (crude MDI).

The B side resin component contains a hydroxy functional polyol. Examples of the polyol component (b) include an alkylene diol such as ethylene glyol, propylene glycol, polyethylene glycol and polypropylene glycol; and a polyester diol such as an esterification product of an excess amount of an alkylene diol with a dicarboxylic acid or its anhydride.

The resulting polyurethane contained a small amount of blowing agent to yield a polyurethane foam having a density of about 0.5 lbs/ft$^3$. The densities, however, may range from 0.25 and 2.0 lbs/ft$^3$. More specifically, a polyol such as polypropylene glycol is treated with a diisocyanate in the presence of some water and a catalyst (amines, tin soaps, organic tin compounds). As the polymer forms, the water reacts with the isocyanate groups to cause crosslinking and also produces carbon dioxide, which causes foaming. In other cases, trifluoromethane or similar volatile material may be used as blowing agents.

The density of the foams I use may vary widely. Typically, the density of the foam is greater than 1.0 lbs/ft$^3$ and the density of the foam in the V-shape is less than 1.0 lbs/ft$^3$.

The long term care bed includes a mattress and side rails. A cover defining an interior space is formed of a material that is flexible, nonabrasive and substantially resistant to penetration by an appendage of a person. A top attachment means secures a top section of the cover to a top rail of the bed rails and a bottom attachment means secures a bottom section of the cover to a bed frame beneath the mattress. A foam material fills the interior space defined by the cover wherein the foam material has a higher density. The higher density foam material defines at least one V-shaped cavity pointing downwardly towards the bottom section of the cover and a lower density foam fills the V-shaped cavity. The bottom surface of the cover is positioned adjacent a top surface of the mattress to provide zero clearance between the mattress and side rails.

In another embodiment, the V-shape portion of the pad may contain no material at all. I strongly recommend, however that this portion of the pad contain a less dense or soft material.

The cover of the pad may vary widely. Generally, the cover is made of a vinyl material. The covers preferably are based on homopolymers or copolymers of vinyl chloride, for example vinyl chloride/vinyl acetate copolymers. The homopolymers and the copolymers are both commonly referred to as PVC resins or PVC polymers. Compositions which comprise PVC resin are commonly referred to as PVC compositions or simply as PVC. PVC compositions which contain little or no plasticizer (for example up to about 2% by weight) are relatively rigid and brittle, and they are commonly referred to as rigid PVC, unplasticized PVC or UPVC. PVC compositions which contain relatively large amounts of plasticizer (for example around 10%–40%, by weight) are more flexible and have a lower modulus, and they are commonly referred to as flexible PVC, plasticized PVC or PPVC. The plasticizer may be a simple ester plasticizer, also known as monomeric plasticizer. Naturally, the cover of this invention preferably is a flexible PVC.

Preferably, the materials of this invention are flame-resistant and have a low-smoke value. This usually is accomplished by incorporating a metallic salt such as aluminum trihydrate. Typically, the materials should have a flame spread of 25 or less and a smoke value of less than 400 according to standard ASTM tests.

The straps of this invention may vary widely. The straps have tabs that are secured in place with hook and loop fasteners or with quick-release buckles. The fasteners should be located on the cover to face away from a patient to reduce risk to injury. The top straps of the pad fasten to the top rail of the bed rails. The bottom straps are secured below the mattress to the bed frame, springs or the bottom side of the mattress. The pad has a bottom side that rests on the top side of the mattress. Because of this, the mattress acts as a spring and the pad moves with the mattress. When the mattress is compressed as when the bed is placed in an articulated position or elevated position, the pad moves with the mattress. The bottom side of the pad remains pressed against the top side of the mattress. This results in a zero gap between pad mattress and rail. When the bed is articulated, the movement causes the pad to bend at the V-shape portions. This keeps the pad firmly against the mattress rather than create a gap as with conventional pads.

The straps used with pad may have different lengths and widths. Typically, the straps may be ¾ inch or 1 inch in width. The length of the straps typically is up to 12 inches depending upon the thickness of the mattress, bed framework rail height and the like. A practical solution is to make the straps longer than necessary to accommodate many sizes.

While the pad has at least one V-shaped section, it may have more than one. Often 2 or 3 V-shaped are used to more easily conform to the shapes a hospital bed may have. Also, the pad may use a combination of V-shapes and inverted V-shapes mattress configurations.

The bottom of the pad, typically between the cover and foam also contains a stiffening member such as ½ inch electrical conduit pipe. In compression, the conduit further maintains the surfaces of the pad and mattress in contact with each other thereby maintaining the zero gap.

The following example further illustrate this invention:

EXAMPLE I

FIGS. 1 and 2 show a pad according to this invention. The pad had the following properties and dimensions. FIG. 2 shows a V-shape section and an inverted V-shape section. Pad 10 typically has the following construction.

FIGS. 1 and 2

1. Scale: 1"=1'
2. ½" electrical conduit
3. 1" wide vinyl strap—sealed and stitched
4. 1" wide vinyl strap—sealed and stitched
5. Fasteners: four ¾" quick-release buckles at top
6. Fasteners: four 1½" quick-release buckles at bottom
7. Left side bed rail pad requires dimensions 37 and 41½ to be reversed
8. Materials: a) vinyl; b) foam; and c) foam

EXAMPLE II

Another pad according to this invention has the following properties and dimensions. The pad may have a V-shape section and an inverted V-shape section or a multiplicity of V-shaped sections.

1. Scale: 1"=1'
2. ½" electrical conduit
3. 1" wide vinyl strap—sealed and stitched
4. 1" wide vinyl strap—sealed and stitched
5. Fasteners: four ¾" quick-release buckles at top
6. Fasteners: four 1½" quick-release buckles at bottom
7. Left side bed rail pad requires dimensions 37 and 41½ to be reversed
8. Materials: a) vinyl; b) foam; and c) foam

EXAMPLE III

FIG. 3 shows a mattress pad spacer for the bed bottom. The headboard and top of the mattress are compressed together by use of the footboard pad.

FIGS. 3–5 show the pads in position on a hospital bed. Note, the pads are flush with each other at the four corners of the bed.

The following materials were used in the pads shown in the Figs.

1. Dense foam (Ohio Foam) #240125
2. ½" conduit (electrical)
3. Buckles (snap) #SR 1½" (Nexis) Astrup
4. Strap bottom #1936 Mfg. Ltc. 1"×12"
5. Urethane supported film MIL-83849 Type #1

FIG. 5 shows a hospital bed with one rail up and one rail down. The one rail up has the pad flipped over on the outside for linen change. The one rail down is below the mattress with the pad flipped to the outside for linen change. Rails 34 and pad 10 may be ½ rails and ½ pads. Long term care is widely using ½ rails as enablers. The ½ rail also can be a restraint. The enabler still has 1" gap problem.

The mesh on the half pad viasion, like the full rail pad, enables the patient to control the positioning of the bed (electric). Most bed manufacturers have placed controls for electric beds both on the patient side and care giver side of the half rail.

There are still other bed manufacturers that have added a remote control device by wire to the underside of the bed. This invention also secures the wire, while the remote sits on the patient's stomach.

This invention works well with various bed type and various rails. All are made with big gaps with various mattress widths are for sale. Lengths also vary. Incorrect ordering will increase the gap problem. Beds vary from 76" to 80" long. Mattresses vary from 72" to 84" long and 32" to 39" wide.

In addition to these embodiments, persons skilled in the art can see that numerous modifications and changes may be made to the above invention without departing from the intended spirit and scope thereof.

I claim:

1. A pad for use with a bed having a mattress and side rails wherein the pad provides zero clearance between the mattress and side rails comprising:

a cover defining an interior space formed of a material the material being flexible, non-abrasive, and substantially resistant to penetration by an appendage of a person;

a top attachment means connected to a top section of the cover;

a bottom attachment means connected to a bottom section of the cover;

a first foam filling the interior space defined by the cover; and the first foam further defining at last one V-shaped cavity pointing downwardly towards the bottom section of the cover wherein the cavity is a void.

2. A pad according to claim 1 wherein a second foam fills the V-shaped cavity wherein the second foam has a lower density than the first foam.

3. A pad according to claim 1 including a stiffening member located adjacent the bottom section of the cover.

4. A pad according to claim 2 wherein the foams have a density ranging from 0.25 to 2.0 lbs/ft$^3$.

5. A pad according to claim 1 wherein the first foam has a density greater than 1.0 lbs/ft$^3$.

6. A pad according to claim 2 wherein the second foam has a density lower than 1.0 lbs/ft$^3$.

7. A pad according to claim 2 wherein the foams are urethane foams.

8. A pad according to claim 2 wherein the V-shaped cavity contains a soft material.

9. A pad according to claim 1 wherein the V-shaped cavity contains no material.

10. A pad according to claim 1 including at least one V-shaped cavity pointed upwardly towards the top section of the pad.

11. A pad according to claim 1 including a multiplicity of V-shaped cavities, wherein at least one of the cavities point upwardly and at least one of the cavities points downwardly.

12. A pad for use with a bed having a mattress and bed rails comprising:

a cover defining an interior space formed of a material the material being flexible, non-abrasive, and substantially resistant to penetration by an appendage of a person;

a top attachment means for securing a top section of the cover to a top section of the bed rails;

a bottom attachment means for securing a bottom section of the cover to a bed frame beneath the mattress;

a first foam filling the interior space defined by the cover;

the first foam further defining at least one V-shaped cavity pointing downwardly towards the bottom section of the cover wherein the cavity is a void; and the bottom surface of the cover positioned adjacent to a top surface of the mattress to provide zero clearance between the mattress and side rails.

13. A pad according to claim 12 wherein a second foam fills the V-shaped cavity wherein the second foam has a lower density than the first foam.

14. A bed comprising:

a mattress;

at least one side rail;

at least one pad including a cover defining an interior space formed of a material the material being flexible, non-abrasive, and substantially resistant to penetration by an appendage of a person;

a top attachment means securing a top section of the cover to a top rail of the bed rail;

a bottom attachment means securing a bottom section of the cover to a bed frame beneath the mattress;

a first foam filling the interior space defined by the cover;

the first foam further defining at least one V-shaped cavity pointing downwardly towards the bottom section of the cover wherein the cavity is a void; and the bottom surface of the cover positioned adjacent a top surface of the mattress to provide zero clearance between the mattress and side rails.

15. A bed according to claim 14 wherein a second foam fills the V-shaped cavity wherein the second foam has a density lower than the first foam.

16. A bed according to claim 14 wherein the rail is a ½ rail and the pad is a ½ pad.

17. A bed according to claim 14 wherein the at least one side rail is a pair of side rails adjacent each side of the mattress.

18. A bed according to claim 17 wherein the at least one pad is a pair of pads, each of the pads of the pair attached to each of the side rails of the pair of side rails.

19. A bed according to claim 18 including a mattress pad spacer wherein the mattress has a foot end, the pair of pads have a foot end and the mattress pad spacer is in compression with the foot ends of the pair of pads at the foot end of the mattress.

20. A bed according to claim 18 including a head board wherein the mattress has a head end, the pair of pads have head ends and the head ends of the mattress and the pair of pads are in compression with the head board.

21. A bed according to claim 18 having four corners wherein the pair of pads is in compression with the four corners of the bed.

* * * * *